US005244441A

United States Patent [19]

Dempster et al.

[11] Patent Number: 5,244,441

[45] Date of Patent: Sep. 14, 1993

[54] POSITION-BASED MOTION CONTROLLER

[75] Inventors: Philip T. Dempster, St. Helena; Joe Forma, Grass Valley; Gary Engle, Fair Oaks; Fredrick Luffman, Sacramento, all of Calif.

[73] Assignee: Loredan Biomedical, Inc., West Sacramento, Calif.

[21] Appl. No.: 866,112

[22] Filed: Apr. 7, 1992

Related U.S. Application Data

[63] Continuation of Ser. No. 472,399, Jan. 31, 1990, abandoned.

[51] Int. Cl.[5] ..... A63B 21/00

[52] U.S. Cl. ..... 482/9; 482/901; 128/25 R

[58] Field of Search ..... 128/25, 25 R; 73/379; 482/57, 63, 91, 131, 110, 1, 4, 5, 6-9, 901, 900

[56] References Cited

U.S. PATENT DOCUMENTS 4,889,108 12/1989 Bond et al. ..... 272/129

4,934,694 6/1990 McIntosh ..... 272/125 X

*Primary Examiner*—Richard J. Apley

*Assistant Examiner*—Glenn E. Richman

*Attorney, Agent, or Firm*—Townsend and Townsend Khourie and Crew

[57] ABSTRACT

An isokinetic exercise system includes an active exercise resistance unit and a computer controller. The active exercise resistance unit includes a lever arm assembly attached to a motor, and a patient attachment cuff is slidingly mounted to the lever arm assembly. A potentiometer is used to determine the length of the patient's limb, and a potentiometer/optical encoder assembly is used to determine the angular position of the lever arm assembly as the limb is exercised. A strain gauge assembly is used to determine the torque applied to the lever arm assembly. The limb length, position and torque values are converted into digital form and supplied to a computer. The computer accepts selected velocity and maximum torque value from the operator and uses these values to control the velocity of and torque applied to the lever arm assembly. More specifically, the computer predicts a subsequent lever arm angular position based on the set velocity. If the actual subsequent angular position of the lever arm assembly does not match the expected position, then motor current is directly adjusted to ensure that subsequent actual and calculated positions of the lever arm match. The exercise system also includes a torque limiting function wherein the torque applied to the lever arm or patient attachment device is limited to a set maximum. If the patient attempts to exceed this maximum torque, then the motor accelerates the lever arm to keep the torque within the prescribed limits.

17 Claims, 16 Drawing Sheets

POSITION-BASED MOTION CONTROLLER

This is a continuation of application Ser. No. 07/472,399 filed Jan. 31, 1990, now abandoned.

BACKGROUND OF THE INVENTION

This invention relates generally to exercise and rehabilitation systems and methods and, more specifically, to an active isokinetic exercise and rehabilitation system wherein isokinetic velocity is maintained in response to position of and torque applied to a patient attachment unit.

Research conducted over the past decade has demonstrated the value of isokinetic exercise from the standpoint of rehabilitating injured human joints and associated muscle groups as well as training joints and muscle groups for improvement of human performance. The term "isokinetic" refers to the exercise concept that involves restricting the movement of a portion of the body about a particular anatomical axis of rotation to a constant rotational velocity. This is achieved by applying an accommodating resistive force to the contracting muscle. This resistive force changes in value throughout the range of motion of the limb in a manner which opposes the varying amount of force that the associated muscle group is able to generate.

The observation that the amount of force which a muscle group generates varies throughout the range of motion of the associated joint may be explained in terms of anatomical axis of rotation (i.e., a variable biological lever length advantage), enzymatic profile (i.e., intracellular contractile and metabolic protein composition), musculo-tendinous length tension relation and ballistic considerations. An example of this phenomenon can be shown in the knee joint extension during which the quadriceps muscle is seen to develop peak torque at about the midrange of rotation.

Conventional methods of "free weights" exercise require the muscle to act against a load which cannot be greater than the torque developed at the weakest point in the range of motion of the joint. Thus, with free weights the muscle operates at a reasonable work load in only a small portion of the overall range of motion, and the muscle does not experience optimal loading at the stronger points in the range of motion.

Semi-accommodating resistance exercise, wherein the load on the muscle is biased and semi-variable, is provided in some cam-based exercise systems. However, these systems are at best approximations to the variations in force generated by the particular muscle groups sampled from a cross-section of individuals. This approximation of variable force generation, which may be visualized as a quasi bell-shaped curve of force plotted against degrees of range of motion, is used to shape a cam to control application of the resistive force in a semi-accommodating, semi-variable manner.

Isokinetic exercise systems, on the other hand, create a variable force which imitates and opposes the variable force generated by the involved muscle group as the limb moves throughout its range of motion. In this type of system, the rotational velocity of the lever arm or other patient attachment unit to which the limb is attached is constrained to a maximum permitted value, and any force exerted by the limb which tends to accelerate the lever arm beyond that maximum value is matched with an accommodating resistance. Accordingly, the muscle group involved operates at its optimal tension development throughout the entire range of motion. The net rehabilitation benefit or the net gain in human performance using this technique is substantially greater than that achieved with conventional exercise techniques.

Isokinetic exercise systems may be passive or active. A passive exercise system is shown in U.S. Pat. No. 4,601,468 issued to Bond, et al. An active exercise system is exemplified in U.S. Pat. No. 4,628,910 issued to Krukowski. In these systems, a servo motor is mechanically coupled to a movable arm against which a force can be applied. A sensing device senses the force applied to the arm and produces a load signal corresponding thereto. A tachometer produces a velocity signal corresponding to the velocity of the arm, and a closed loop velocity servo feedback circuit controls the motor in response to the load signal and the velocity signal so that the arm has a constant resistive torque applied thereto and/or has its velocity regulated regardless of the force applied to the arm.

However, velocity servo control loops used in known active exercise systems require adjustment of analog signals which, in turn, are subject to electrical perturbations.

SUMMARY OF THE INVENTION

The present invention is directed to a position-based active exercise system wherein an expected subsequent position of a movable arm or other patient attachment device is calculated based upon the desired velocity and current position of the arm or attachment device. A subsequent actual position of the arm or attachment device is compared to the expected subsequent position of the arm or attachment device, and the drive motor is directly controlled to maintain correspondence between the actual and expected positions. Since the servo mechanism is position-based, it is possible to simulate the entire range of motion digitally. Accordingly, calibration of velocity is as accurate as the clock in the computer and does not require adjustment of analog signals. Because the system is based on discrete position values, error checking is more convenient, and the system is less sensitive to electrical perturbations. Since motor current may be directly controlled by the computer, system response is faster than known velocity based servo mechanisms. By closing the servo loop digitally, the characteristics of the servo loop can be controlled through computer software and is thus easily modifiable.

In one embodiment of the present invention, an isokinetic exercise system includes an active exercise resistance unit and a computer controller. The active exercise resistance unit includes a lever arm assembly attached to a motor, and a patient attachment cuff is slidingly mounted to the lever arm assembly. A potentiometer is used to determine the length of the patient's limb, and a potentiometer/optical encoder assembly is used to determine the angular position of the lever arm assembly as the limb is exercised. A strain gauge assembly is used to determine the torque applied to the lever arm assembly. The limb length, position and torque values are converted into digital form and supplied to a computer. The computer accepts selected velocity and maximum torque value from the operator and uses these values to control the velocity of and torque applied to the lever arm assembly. More specifically, the computer predicts a subsequent lever arm angular position based on the set velocity. If the actual subsequent angular position of the lever arm assembly does not match the expected position, then motor current is directly adjusted to ensure that subsequent actual and calculated positions of the lever arm match.

The exercise system according to the present invention also includes a torque limiting function wherein the torque applied to the lever arm or patient attachment device is limited to a set maximum. If the patient attempts to exceed this maximum torque, then the motor accelerates the lever arm to keep the torque within the prescribed limits.

DETAILED DESCRIPTION OF THE PREFERRED EMBODIMENTS

Figure 1:
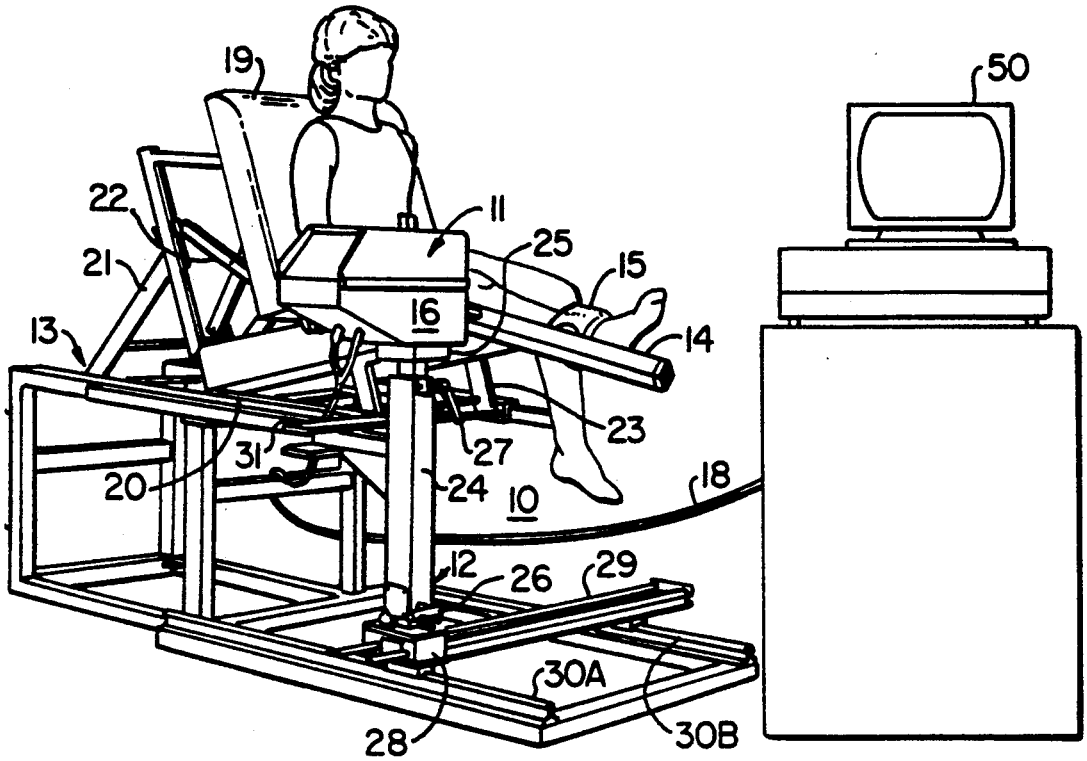
FIG. 1 is an elevational view of a particular embodiment of a position-based active exercise system according to the present invention.

The position-based motion controller according to the present invention is preferably incorporated into a overall isokinetic station which has been designed for maximum utility in patient positioning, optimum flexibility in set up for exercise of various portions of the human body, and minimum involved floor space. As shown in FIG. 1, an isokinetic station 10 includes an active exercise resistance unit 11, a mounting arrangement 12 and a patient couch 13. The active resistance unit 11 includes a lever arm assembly 14, a patient attachment cuff 15, and a housing 16 which contains a motor 17 (FIG. 2) together with electronic controls. The housing 16 further includes input/output leads 18 which provide measurement signal outputs and control signal inputs between a computer 50 and active resistance unit 11. The details of the electronic components of the position-based motion controller will be discussed below in connection with other drawing figures.

The patient couch arrangement 13 includes two cushion portions 19 and 20 which, together with various positioning elements, provide for positioning of a patient in a sitting or reclining orientation. Which position is selected depends on the patient limb being exercised. In the set-up shown in FIG. 1, the cushion portion 19 serves as a backrest, and the cushion portion 20 serves as a seat. A pair of positioning members 21 control the angular orientation of the cushion portion 19, and a scissors jack type of positioning arrangement 22 controls the forward and backward position of the cushion portion 19. Positioning supports 23 control the angle of the cushion portion 20. To put the patient in a reclining position, the positioning members 23 and 21 are reoriented so that the cushion elements 19 and 20 are horizontal and in line with each other.

The mounting and positioning system 12 includes a vertical pedestal arrangement 24 which includes a rotary support member 25 to which the housing 16 of the active resistance unit is attached. Preferably a detente arrangement is provided such that the angular orientation of the housing 16 relative to the patient couch can be selectively altered to fixed angeles. A height adjustment jacking arrangement operated by a jack handle 26 is provided within the pedestal 24 to raise and lower the housing 16 for positioning of the axis of rotation of the lever arm assembly 14 relative to the patient.

The pedestal assembly 24 is mounted on a bearing slide arrangement 28 which permits side-to-side movement of the pedestal assembly 24 relative to the patient couch. Another bearing and track arrangement 30A and 30B permits front-to-back movement of the pedestal 24 carried on the bearing and track arrangement 28 and 29. A stabilizing arrangement 31 is provided to rigidly fix the pedestal 24 in a particular selected position relative to the patient couch assembly 13.

Figure 2:
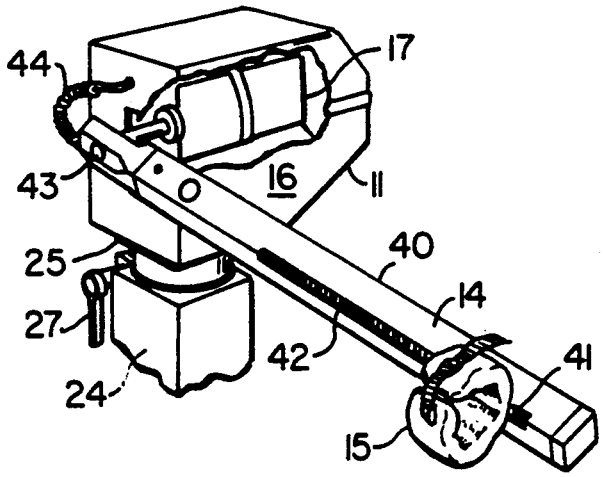
FIG. 2 is a partly sectioned elevational view of a particular embodiment of the exercise resistant unit shown in FIG. 1.
Figure 4:
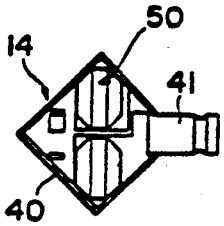
FIG. 4 is a partially sectioned view taken along lines 4—4 in FIG. 3.
Figure 3:
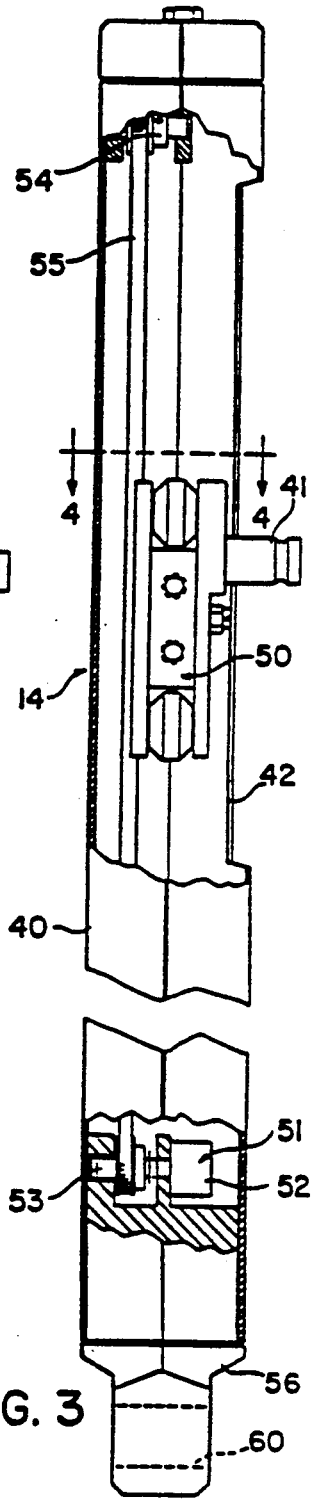
FIG. 3 is a partly sectioned elevational view of a particular embodiment of a lever arm assembly according to the present invention.

FIGS. 2–4 illustrate in more detail one embodiment of a lever arm assembly 14. Of course, many types of lever arm assemblies 14 may be provided for exercising different portions of the human body, and different patient attachment devices may be provided in order to provide an appropriate type of interface to the portion of the patient's body to be exercised. Lever arm assembly 14 has a patient attachment cuff 15 which is mounted to the lever arm assembly in a manner such that the patient attachment point is free to move radially during an exercise motion. In the particular embodiment shown in FIGS. 2–4, lever arm assembly 14 comprises a hollow square tube 40 having an elongated slot 42 in one corner thereof. An attachment post 41 extends through the slot 42 and, as shown in FIG. 4, is carried on a bearing assembly 50 which traverses the interior of the hollow square tubing 40. A solid end member 56 is attached to one end of the hollow square tubing 40. End member 56 includes an aperture 60 therethrough which permits lever arm assembly 14 to be mounted on shaft 43 as shown in FIG. 2. Shaft 43 extends into the housing 16 and, in a preferred embodiment, this shaft is part of motor 17 which provides the resistive component of the exercise system. A cable 44 connects the potentiometer arrangement 51 shown in FIG. 3 to the electronic control circuitry which is provided within the housing 16.

The potentiometer arrangement 51 includes a rotary potentiometer 52 which is coupled to a pulley and belt arrangement comprising a first pulley 53 on one end of the lever arm assembly 14, a second pulley 54 mounted on the other end of lever arm assembly 14, and a belt 55. Belt 55 is carried on the two pulleys and is driven by a fixed connection to the carriage assembly 50 which traverses the interior of lever arm assembly 14. Accordingly, as the carriage assembly 50 translates back and forth within the lever arm assembly, the rotary potentiometer 52 is driven to provide a position signal for the electronic circuitry which will be discussed in more detail below. This position signal corresponds to the current lever arm length, i.e., the distance from the center of the shaft to the point of patient attachment which changes during an exercise motion.

Figure 5:
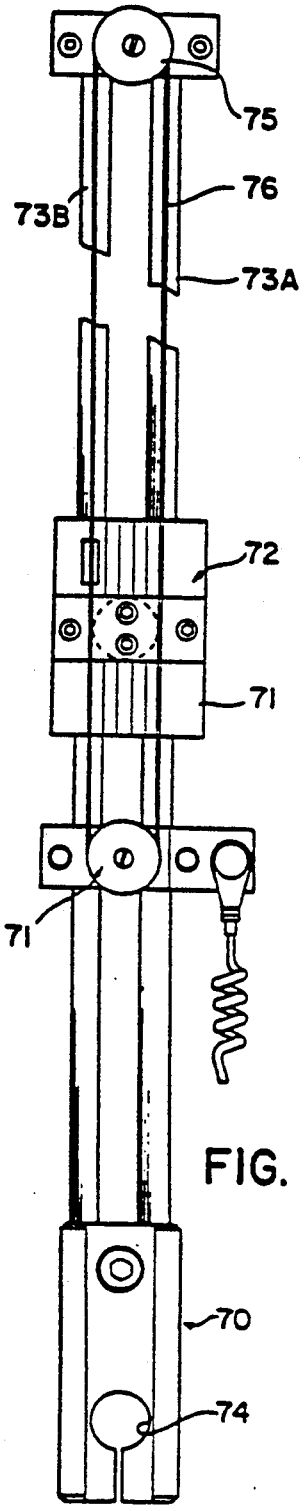
FIG. 5 is an elevational view of an alternate embodiment of a lever arm assembly according to the present invention.

FIG. 5 illustrates another embodiment of a lever arm assembly which uses a bearing and track arrangement 72 having a bearing block 71 riding on a pair of tracks 73A and 73B. A potentiometer and first pulley 71 is fastened to the tracks 73 at one end, and a second pulley 75 is provided on the opposite end of the lever arm assembly 70. A continuous belt 76 is attached to the bearing block 71 to drive the potentiometer arrangement as the bearing block 71 translates on the tracks 73. A coupling element similar to attachment post 41 is provided for coupling the bearing block 71 to a patient attachment device. The aperture 74 is used to mount the lever arm assembly to the actuator shaft in the same manner as the corresponding mounting aperture of the lever arm assembly 14.

Figure 6:
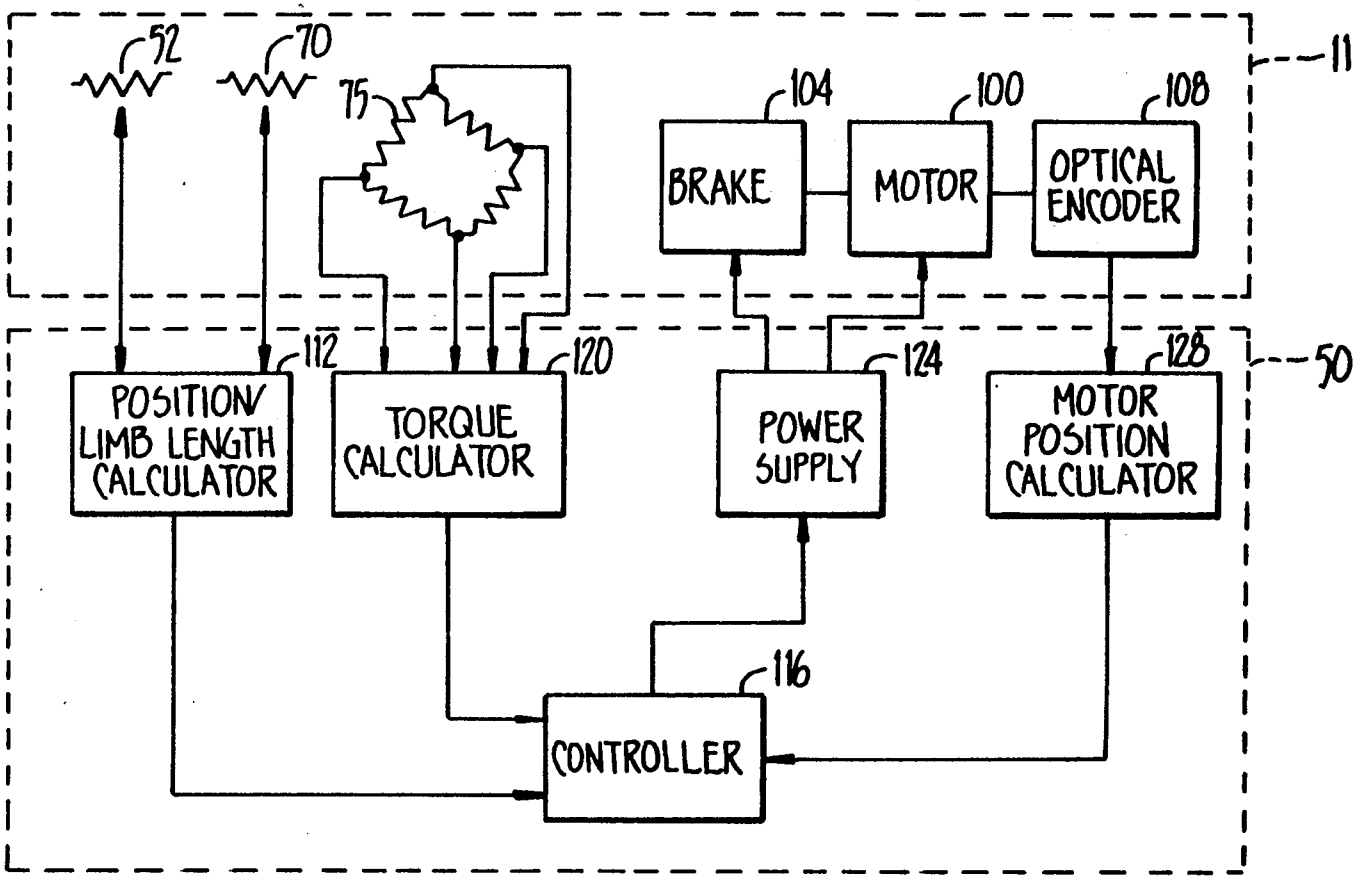
FIG. 6 is a partial block diagram of a particular embodiment of the electrical components of the position-based motion controller according to the present invention.

FIG. 6 is a block diagram of the electronic components of a position-based motion controller according to the present invention. Active exercise resistance unit 11 includes potentiometer 52 for measuring limb length, a potentiometer 70 for measuring the angular position of the lever arm, and a strain gauge assembly 75 for measuring the torque applied to lever arm assembly 14. The operation of potentiometer 52 has been discussed above. Potentiometer 70 and strain gauge assembly 75 may be disposed on lever arm assembly 14 in a convenient manner to perform the functions indicated. For example, potentiometer 70 may be mounted on square tubing 40 or shaft 43 for rotation relative to housing 16, whereas strain gauge assembly 75 may be disposed on square tubing 40 or shaft 43 to measure the flexing of the tubing or shaft as a function of applied torque. Active exercise resistance unit 11 further includes a motor 100 for actively controlling the rotation of shaft 43, a brake 104 for maintaining shaft 43 in a fixed position, and an optical encoder 108 for detecting the position of the motor shaft. Optical encoder 108 is calibrated to potentiometer 70 so that optical encoder 108 provides a separate indication of the angular position of the lever arm.

Computer system 50 includes a position/limb length calculator 112 which receives position and limb length signals from potentiometers 52 and 70. Position/limb length calculator 112 provides two signals to a controller 116. One signal indicates the limb length as determined by potentiometer 52, and the other signal indicates the angular position of lever arm assembly 14 as determined by potentiometer 70. A torque calculator 120 receives signals from strain gauge assembly 75 and provides a signal to controller 116 indicating the torque applied to lever arm assembly 14. A power supply 124 receives control signals from controller 116 for controlling the operation of brake 104 and motor 100. A motor position calculator 128 receives signals from optical encoder 108 and provides signals indicating the position of motor 100 to controller 116. The structure and operation of position/limb length calculator 112, torque calculator 120, power supply 124, and motor position calculator 128 are well known and will not be discussed here.

Controller 116 is programmed to regulate the movement of lever arm assembly 14 via motor 100 in response to the position, limb length and torque signals received from position/limb length calculator 112 and torque calculator 120. How this is accomplished is shown in FIGS. 7–15.

In operation, computer 50 is powered up, and the operator enters the patient data and desired operating parameters. For example, the operator may specify the isokinetic velocity, the maximum torque, and the maximum range of motion of lever arm assembly 14. Once the range of motion is set, a gravity compensation routine is executed to obtain table values that are used to compensate for the effect of gravity on lever arm assembly 14 throughout the set range of motion. Once the operating parameters are established, the user may enter a number of exercise modes. For example, the operator may specify a concentric/concentric mode of operation wherein the patient actively pushes on lever arm assembly 14 during both clockwise and counterclockwise motion of lever arm assembly 14. Additional modes include concentric/eccentric and eccentric/concentric modes wherein the patient pushes on lever arm assembly 14 in one direction, and lever arm assembly 14 pushes back in the other direction; a continuous positive motion (CPM) mode wherein lever arm assembly 14 moves the patient's limb in both directions at a prescribed speed; an isometric mode wherein lever arm assembly 14 resists applied force; a move limb mode wherein the patient's limb is moved to a prescribed position within the set range of motion at a selected speed; an idle mode wherein lever arm assembly 14 is in a passive state; and a lock limb mode wherein lever arm assembly 14 is maintained in a locked position. In concentric/concentric, concentric/eccentric, eccentric/concentric, CPM and move limb modes, torque is limited to the maximum value set by the operator. That is, if the patient pushes on lever arm assembly 14 (or resists the motion of lever arm assembly 14) with a force which produces a torque that exceeds the value set by the operator, then the isokinetic velocity set by the operator is overridden, and the velocity of lever arm assembly 14 is allowed to increase sufficiently to bring the torque within the set maximum.

Figure 7:
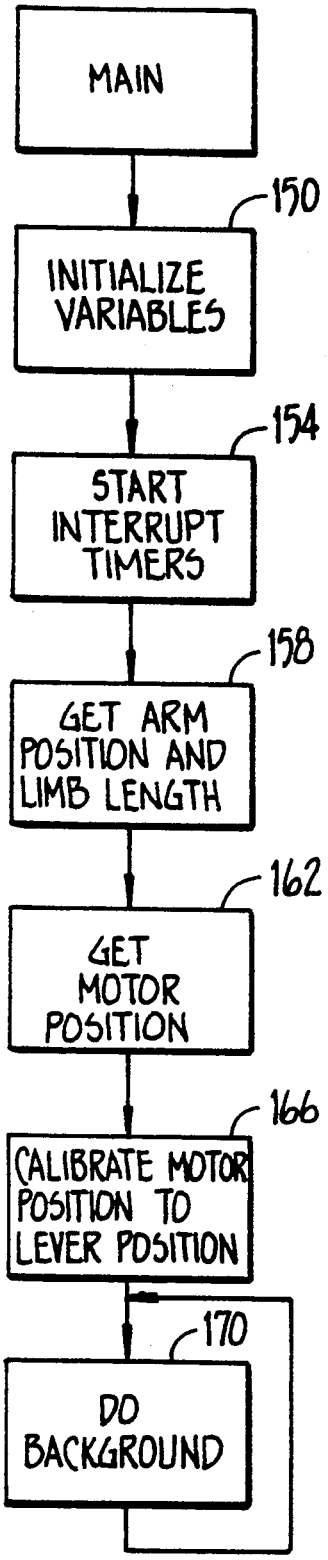
FIGS. 7–15 are flow charts illustrating a particular method of operation of a position-based motion controller according to the present invention.
Figure 8:
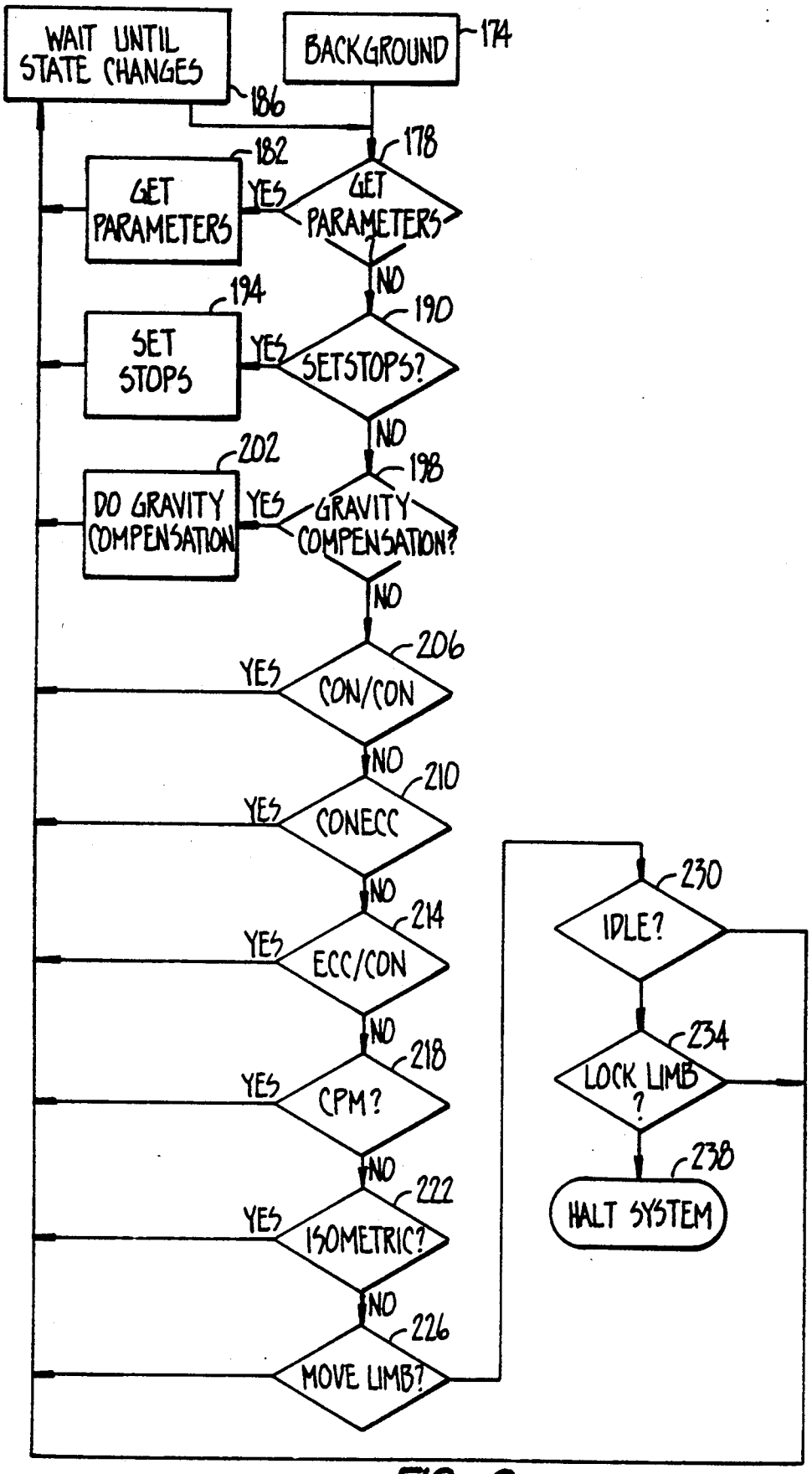

The exercise session begins with execution of a MAIN routine shown in FIG. 7. The MAIN routine begins by initializing variables in a step 150. An interwoven interrupt program structure is used in this embodiment, so a 400 hertz interrupt timer is started in a step 154. The arm position and limb length are retrieved in a step 158, and the motor position is retrieved in a step 162. The motor position then is calibrated to the lever position in a step 166. Thereafter, a background routine is performed in a step 170 until the exercise session is ended or aborted.

The background routine executes in a continuing loop unless and until there is a 400 hertz interrupt which causes execution of a 400 hertz routine. After each four executions of the 400 hertz routine, a 100 hertz routine is called. The 100 hertz routine performs the necessary calculations on the input data, whereas the 400 hertz routine ensures that the proper amount of current is supplied to motor 100.

Execution of the background routine begins in a step 174. The background routine is primarily a passive routine which maintains the status quo until the 100 hertz or 400 hertz routines execute. The only time the background routine executes a routine having any effect on the system is when parameters are input to the system, when the range of motion of the lever arm is set, or when gravity compensation for the lever arm is to be performed.

It is then ascertained in a step 178 whether controller 116 has been instructed to obtain parameters from the operator. If so, the parameters (e.g., isokinetic velocity, maximum torque, patient data, etc.) are obtained in a step 182, and execution continues in a step 186 by waiting until the state changes. If parameters are not to be input at this time, then it is ascertained in a step 190 whether controller 116 has been instructed to set the range of motion of lever arm 14 (i.e., set clockwise and counterclockwise stops). If so, then a set stop routine is executed in a step 194. Details of this routine will be discussed in conjunction with FIG. 10B. Once the clockwise and counterclockwise stops are set, processing continues in step 186 until the state changes. If the stops are not to be set at this time, then it is ascertained in a step 198 whether the gravity compensation routine is to be executed. If so, then the gravity compensation routine is executed in a step 202, and processing continues in step 186. Details of the gravity compensation routine will be discussed in conjunction with FIG. 10C.

If gravity compensation is not to be performed at this time, then it is ascertained in steps 206–234 whether one of the valid exercise modes has been specified. If so, then processing merely continues in step 186. If none of the valid exercise modes has been specified, then system operation ceases in a step 238.

Figure 9:
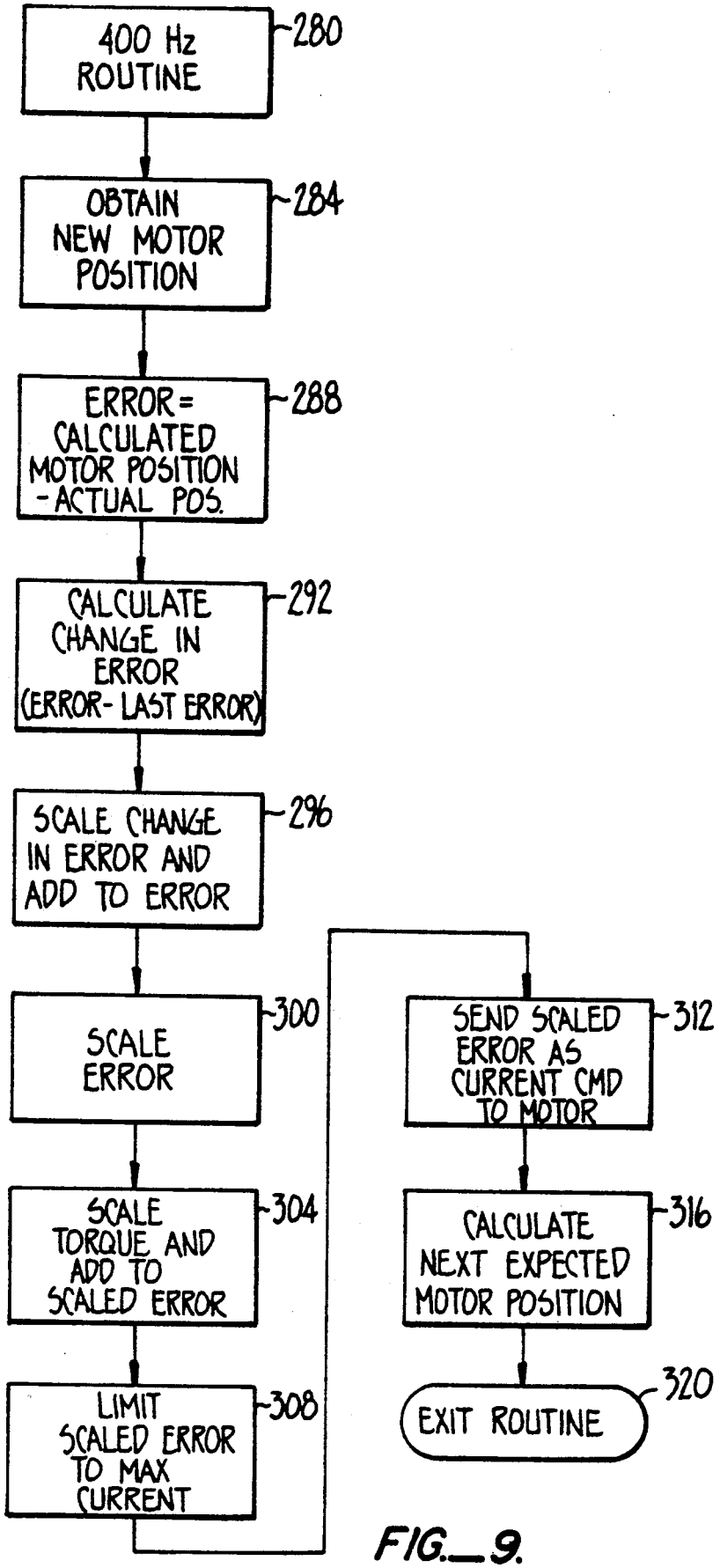

The background routine continues until a 400 hertz interrupt occurs. When the 400 hertz interrupt is received, the 400 hertz routine begins in a step 280 as shown in FIG. 9. The 400 hertz routine compares the actual motor position with an estimated motor position that was calculated based upon a value, termed VELOUT400, which is a position ramp factor derived from the desired velocity parameter input by the operator. If the calculated motor position does not match the actual motor position, then a current command is given to power supply 124 to increase or decrease the amount of current supplied to motor 100.

As shown in FIG. 9, the actual motor position (derived from the optical encoder) is obtained in a step 284. Thereafter, an error value is determined by subtracting the actual motor position from the calculated motor position in a step 288. The amount of change in the error value from the last time the error value was calculated is determined in a step 292. Then, the change in the error value is scaled and added to the error value in a step 296, and the error value is scaled in a step 300. To predict the motor current required to oppose the torque which caused the error, the present torque is scaled and subtracted from the scaled error value in a step 304. To ensure that the new error value does not represent a current beyond the maximum allowed motor current, the scaled error is limited to the set motor current maximum in a step 308. The scaled and limited error value is sent as a current command to the DAC (not shown) in controller 116 which addresses power supply 124 in a step 312. Finally, the next expected motor position is calculated in a step 316, and the 400 hertz routine is exited in a step 320.

After the 400 hertz routine executes four times, the 100 hertz routine is called. The 100 hertz routine begins in a step 400 shown in FIG. 10A. In general, the 100 hertz routine performs various safety checks and updates the value of VELOUT400 (used to control motor current in the 400 hertz routine) based on the position, limb length, and applied torque signals for each operating state. The 100 hertz routine begins by updating the limb length value in a step 404. Then it is ascertained in a step 408 whether active exercise resistance unit 11 has been moved to the other side of the patient. If so, then the gravity compensation routine is performed in a step 412 to obtain the proper gravity compensation values for the new position. The gravity compensation routine will be discussed below in conjunction with FIG. 10C. It is then ascertained in a step 416 whether the motor current is at a safe level. This may be determined by modeling the temperature of the motor based on current supplied to the motor. If the motor current is not at a safe level, then the system is halted in a step 420 to ensure the safety of the operator and patient. If the motor current is within safe limits, it is then ascertained in a step 424 whether the motor power should be turned off (e.g., at the end of the exercise session). If so, then motor power is turned off and the brake is turned on in a step 428. Thereafter, the current values for limb length, lever position, motor current and torque are obtained in a step 432. The current and torque values are corrected for any base line errors in a step 436, and the program variables are adjusted in a step 440 to reflect whether resistance unit 11 is placed on the left or right side of the patient. This allows the same programs to be used for system operation independently of whether resistance unit 11 is located on the left or right side of the patient. For example, if position increment values are positive when the patient lifts his or her limb and the unit is located on the right side of the patient, then position increments values will be negative when the patient lifts his or her limb and the unit is located on the left side of the patient since, in the absolute sense, what was once clockwise rotation is now counterclockwise rotation. Setting the sign of the position increment values positive when the unit is located on the left side of the patient eliminates the need to take the location of unit into account for subsequent calculations.

After the variables have been adjusted, it is ascertained in a step 448 (FIG. 10B) whether the motor and lever arm are in their expected position within a prescribed tolerance. If not, the system operation is halted in a step 452. If the expected motor and lever arm positions are within the prescribed tolerance, it is then ascertained in a step 456 whether the motor and lever arm are in the same position relative to each other. They will not be if the attachment of the lever arm to the motor shaft has become loose, if there is a structural failure in the lever arm or if there is a failure of either potentiometer 70 or optical encoder 108. If that is the case, then system operation is halted in a step 460. If all is well up to this point, it is then ascertained in a step 466 whether the lever arm is within the set stops within a prescribed tolerance. If not, then the lever arm was placed in a position outside the permitted range of motion, and the system operation is halted in a step 470. If the lever arm is within the set stops, it is then ascertained in a step 474 whether the motor and lever arm are calibrated within the prescribed tolerance (i.e., they are located in the same position). If not, then system operation is halted in a step 478. If the motor and lever arm are properly calibrated, then it is ascertained in a step 482 whether it has been an overly abrupt change in torque since the last time torque was checked. If so, then system operation is halted in a step 486. If not, then the system proceeds to process the input data to control motor 100 based on the present exercise mode.

The 100 hertz routine typically will not finish executing before the next 400 hertz interrupt. Nevertheless, the 400 hertz routine is given a higher priority. Thus, to avoid conflicts with the 400 hertz routine, the 100 hertz routine does not update the value of VELOUT400 until the 100 hertz routine has completed. In the meantime, the 100 hertz routine works with a prototype of VELOUT400 termed VELOUT.

It is first ascertained in a step 490 whether the system has been set in idle mode. If so, then VELOUT is set to zero in a step 494, and processing continues in a step 498 shown in FIG. 10D. Step 498 limits VELOUT to the maximum machine velocity. Since VELOUT equaled zero in idle mode, this step has no affect on VELOUT. Thereafter, VELOUT is copied into VELOUT400 in a step 502, and the routine is exited in a step 506.

Figure 10A:
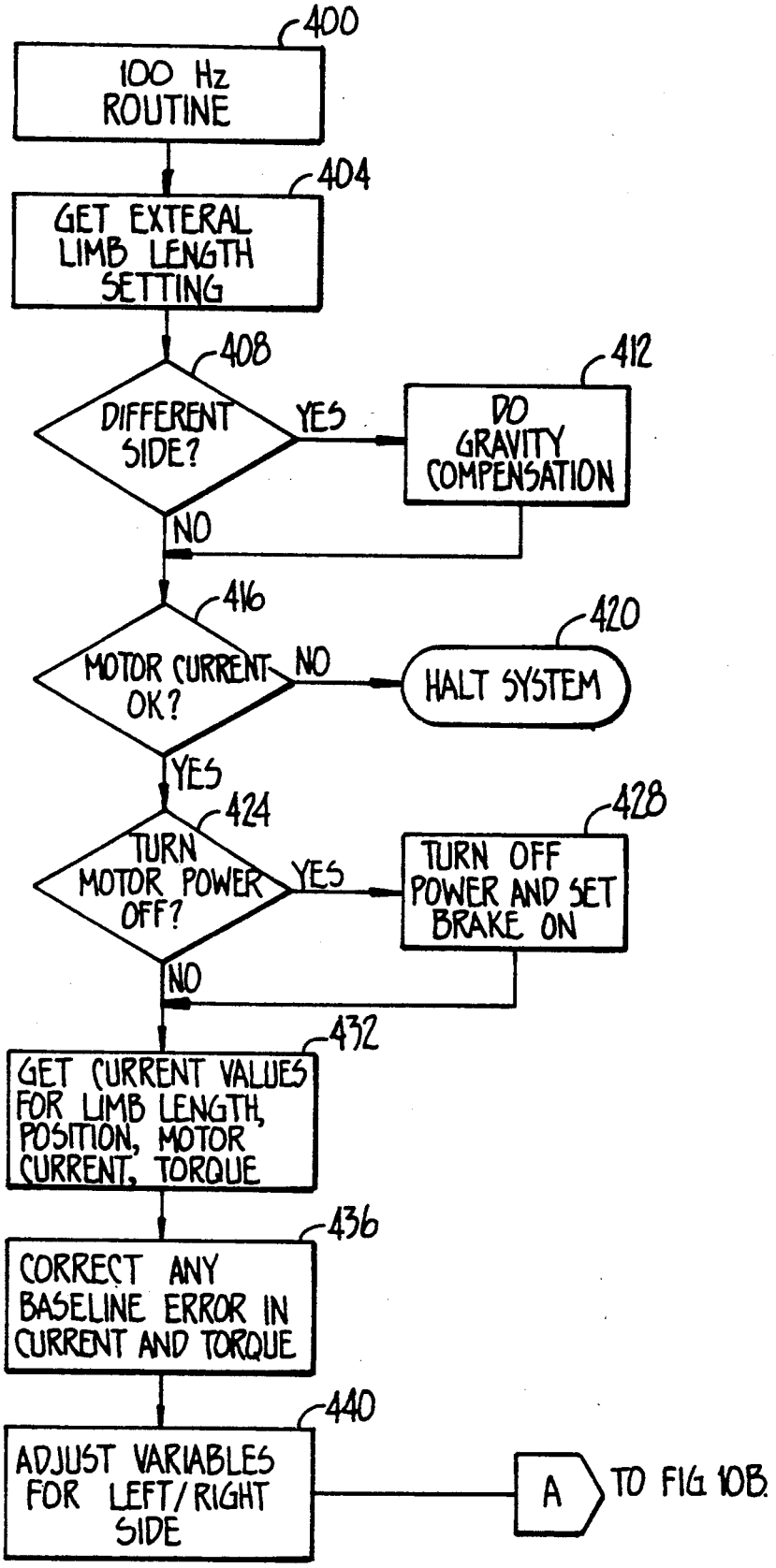
Figure 10B:
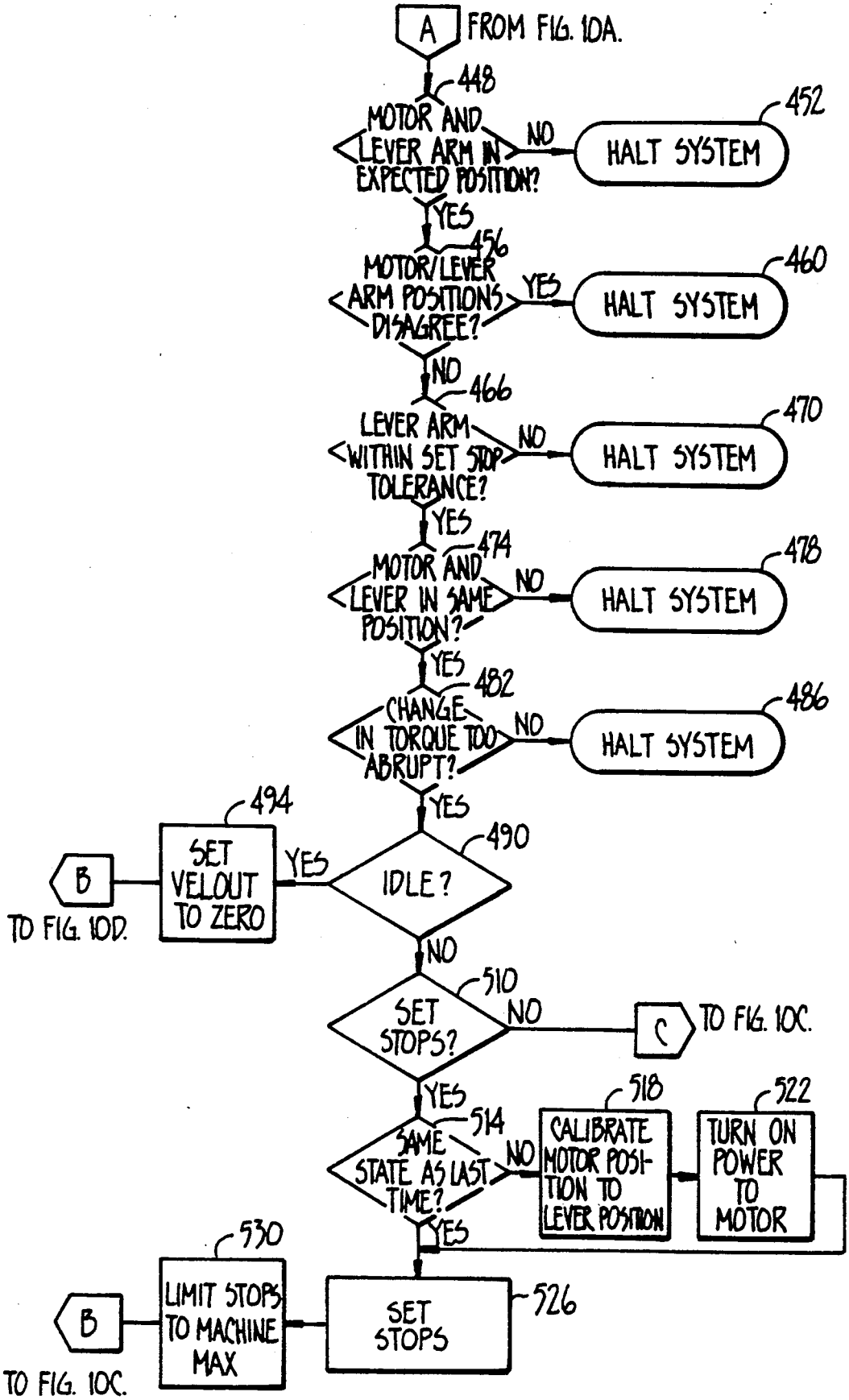
Figure 10C:
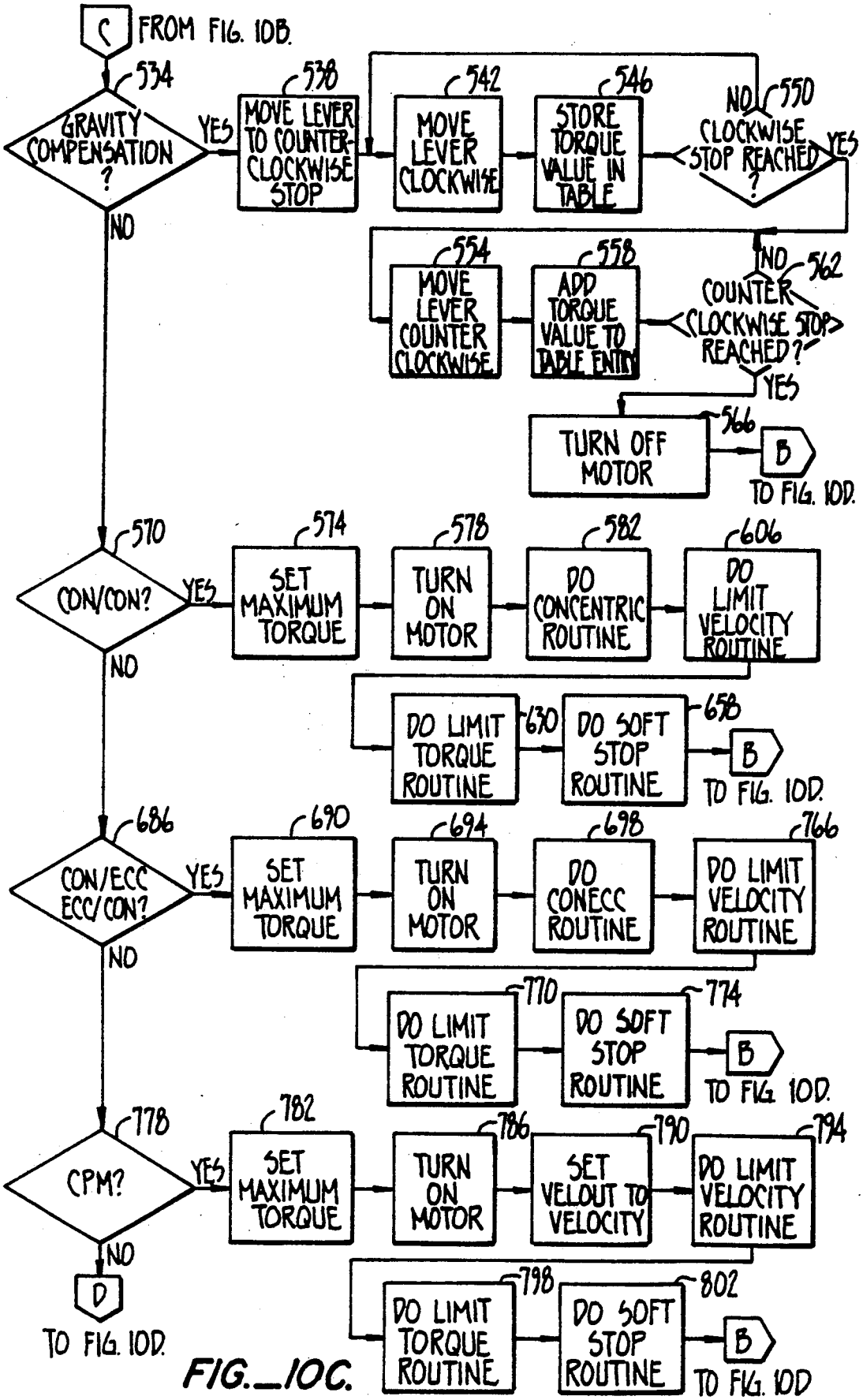
Figure 10D:
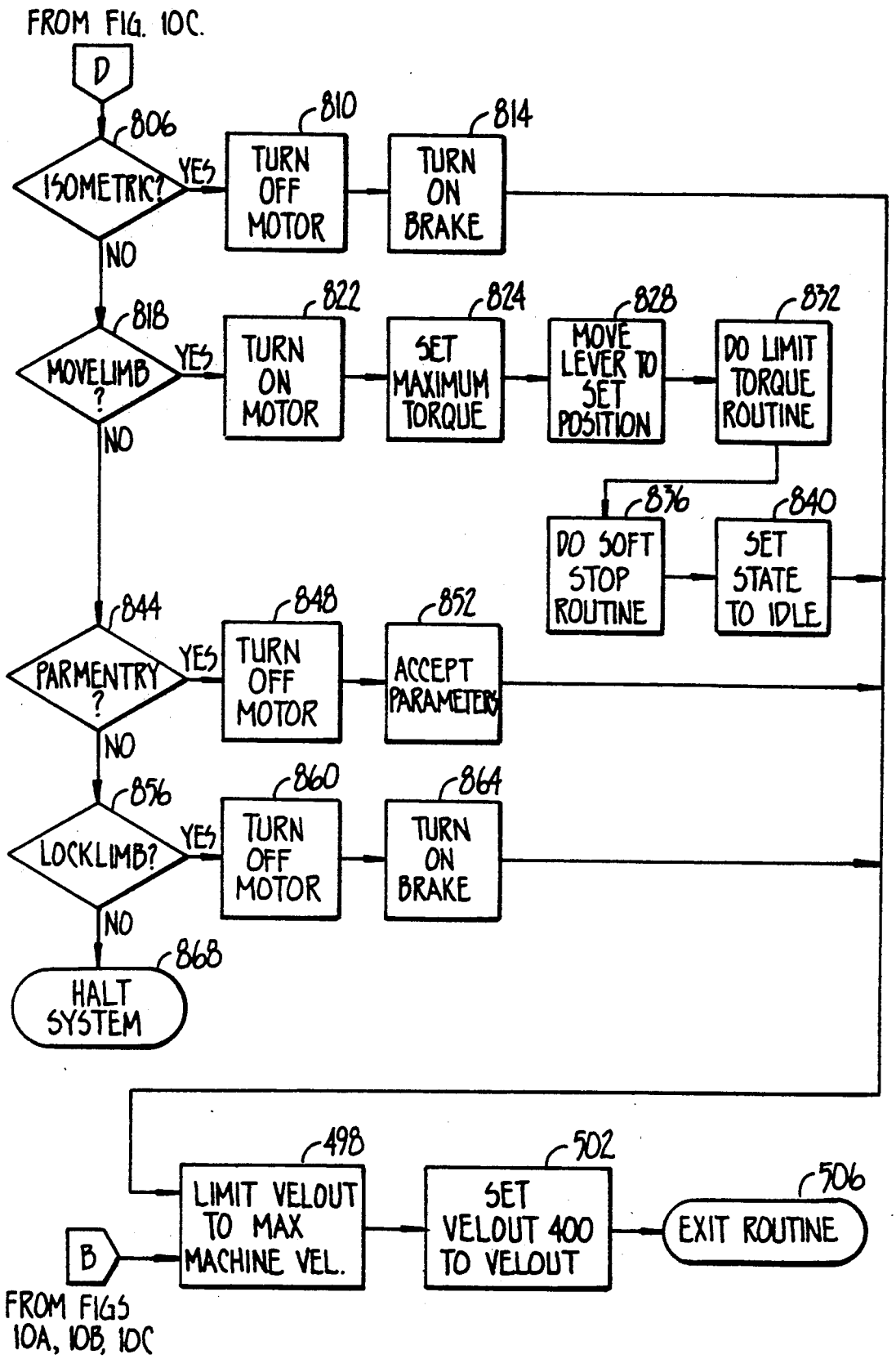

If the system is not set in idle mode, it is then ascertained in a step 510 whether the operator has requested to set the range of motion of the lever arm (i.e., set the stops). If so, then it is ascertained in a step 514 whether the system was in set stop mode the last time it was checked. If not, then the motor position is calibrated to the lever position in a step 518, and motor power is turned on in a step 522. The stops are then set in a step 526. This is accomplished by moving the lever arm to a prescribed position using the cursor control keys on the computer and then storing the clockwise and counterclockwise stop positions. The stops are then limited to the maximum range of motion set for the machine in a step 530. This limitation ensures that the operator cannot set the lever arm range of motion beyond that which is reasonable or safe for the particular machine and patient. Once the stops have been set and properly limited, processing continues in step 498 (FIG. 10D).

If the operator has not requested to set the stop positions, then it is ascertained in a step 534 (FIG. 10C) whether gravity compensation for the lever arm is to be performed. This is desirable after new stops have been set and when the system has been moved from one side of the patient to the other. If gravity compensation is to be performed, then the system automatically moves the lever arm to the counterclockwise stop position in a step 538. Thereafter, the lever arm is moved clockwise in a step 542, and the torque value caused by the effect of gravity on the lever arm for the present position is stored in a table in a step 546. It is then ascertained in a step 550 whether the clockwise stop has been reached. If not, then the system continues moving the lever arm clockwise and storing corresponding torque values in the table until the clockwise stop is reached. Once the clockwise stop is reached, the lever is moved counterclockwise in a step 554, and a corresponding torque value for the present position is added to the table value previously stored for that position in a step 558. It is then ascertained in a step 562 whether the counterclockwise stop has been reached. If not, then the system continues moving the lever clockwise and adding corresponding torque values in the table until the clockwise stop is reached. Once the counterclockwise stop is reached in step 462, the motor is turned off in a step 566, and processing continues in step 498 (FIG. 10D). When the gravity compensation routine is complete, a sum of two torque values for each lever arm position are stored in the table. The gravity compensation torque value then may be calculated as the average of the two values. Of course, summing and averaging could be done over more than two values if desired. The gravity compensation torque values are added to or subtracted from the sensed torque to ensure that the weight of the lever arm does not affect the patient's ability to use the system for its intended purpose and to ensure that the actual patient effort is monitored and controlled.

If gravity compensation is not to be performed at this time, it is then ascertained in a step 570 whether the system has been set in concentric/concentric mode. If so, then the currently set maximum torque value is stored in a step 574, and the motor is turned on in a step 578. The maximum torque value is used to ensure that the torque applied to the lever arm does not exceed the maximum torque set by the operator. If the patient attempts to exceed this maximum torque limit, then motor 100 accelerates the lever arm to ensure that the set torque maximum is not exceeded.

Figure 11:
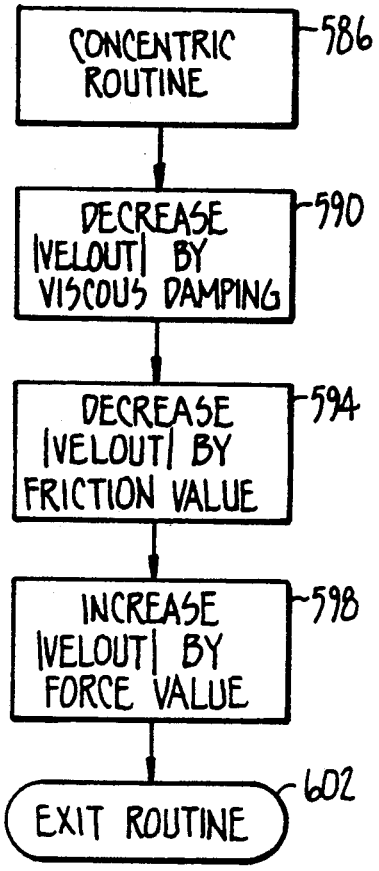

After the motor is turned on, a concentric motion routine is performed in a step 582. The concentric routine is entered in a step 586 (FIG. 11). The function of the concentric routine is to simulate a flywheel with viscous damping. Accordingly, the absolute value of VELOUT is decreased by a viscous damping factor (determined by the programmer) in a step 590, and then the absolute value of VELOUT is decreased by a desired friction value in a step 594. Thereafter, the absolute value of VELOUT is increased by the amount of torque applied by the patient in a step 598. The torque applied to the lever arm in its present position has been adjusted to compensate for gravity using the gravity compensation tables discussed above. The routine is then exited in a step 602.

Once VELOUT has been altered in the concentric routine, it is necessary to ensure that velocity and torque have not exceeded their prescribed limits, especially when a lever arm is nearing the clockwise or counterclockwise stop position. Thus, a limit velocity routine is first performed in a step 606, a limit torque routine is performed in a step 630, and a soft stop routine is performed in a step 658.

Figure 12:
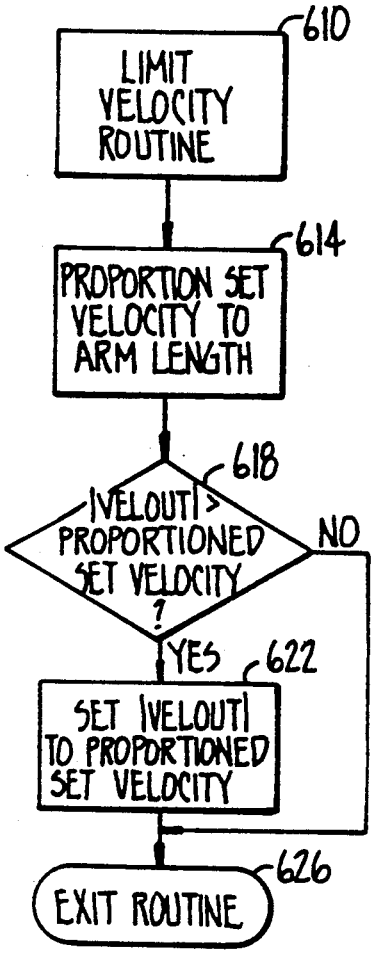

The limit velocity routine is entered in a step 610 (FIG. 12). In this routine, the velocity set by the operator is proportioned in a step 614 to take into account the actual limb length. It is then ascertained in a step 618 whether the absolute value of VELOUT is greater than the proportioned set velocity. If not, the routine is exited in a step 626. If so, then the absolute value of VELOUT is limited to the proportioned set velocity in a step 622, and the routine is exited in step 626.

Figure 14:
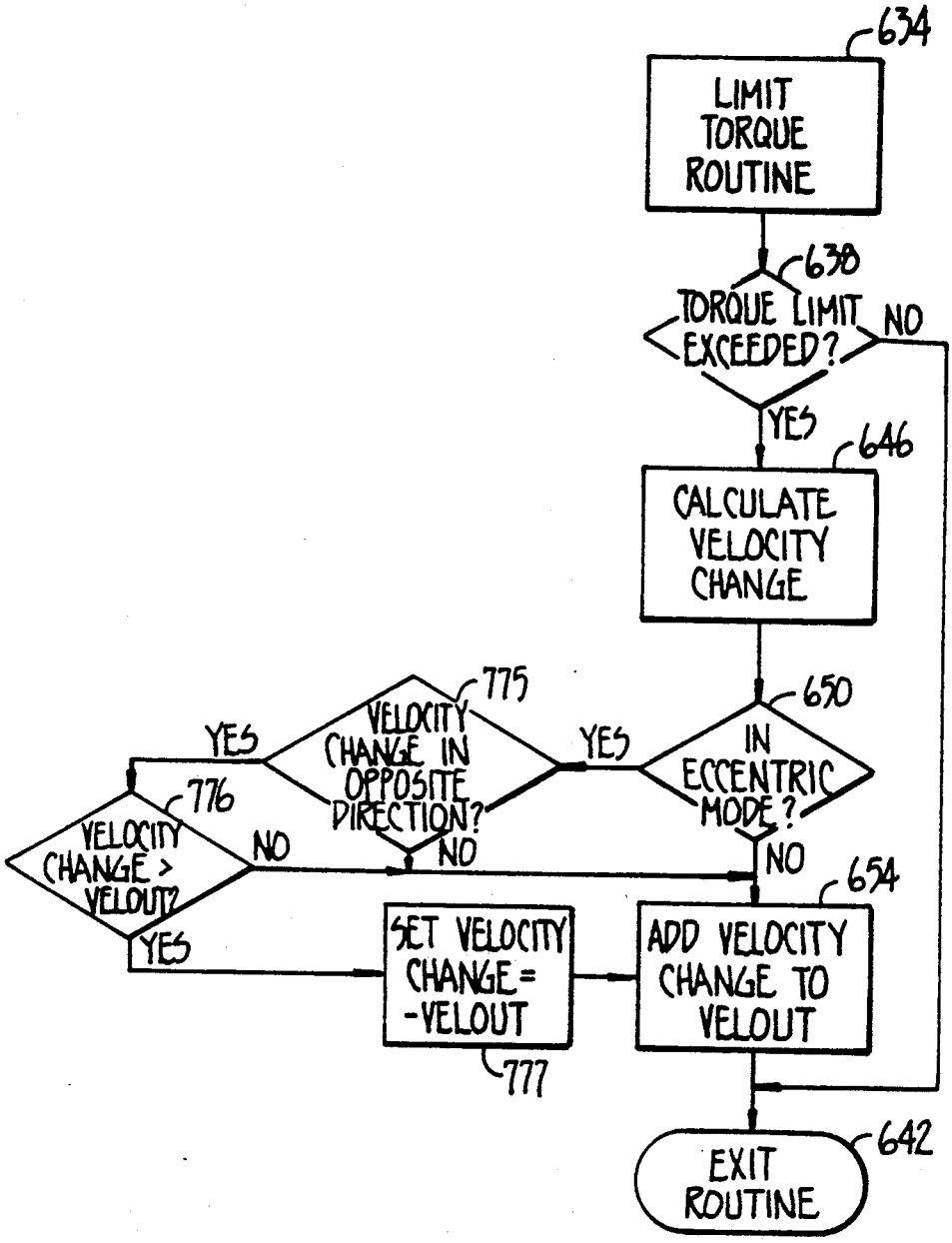

The limit torque routine is entered in a step 634 (FIG. 14). It is first ascertained in a step 638 whether the set maximum torque limit has been exceeded. If not, then the routine is exited in a step 642. If so, then the adjustment to VELOUT estimated to compensate for the excessive torque is calculated in a step 646. It is then ascertained in a step 650 whether the system is presently in eccentric mode. Since we are not in eccentric mode, then the calculated adjustment value is added to VELOUT in a step 654, and the routine is exited in step 642. It should be noted that an isotonic exercise mode may be added merely by executing the concentric exercise routine with a set velocity of zero and a nonzero torque limit.

Figure 13:
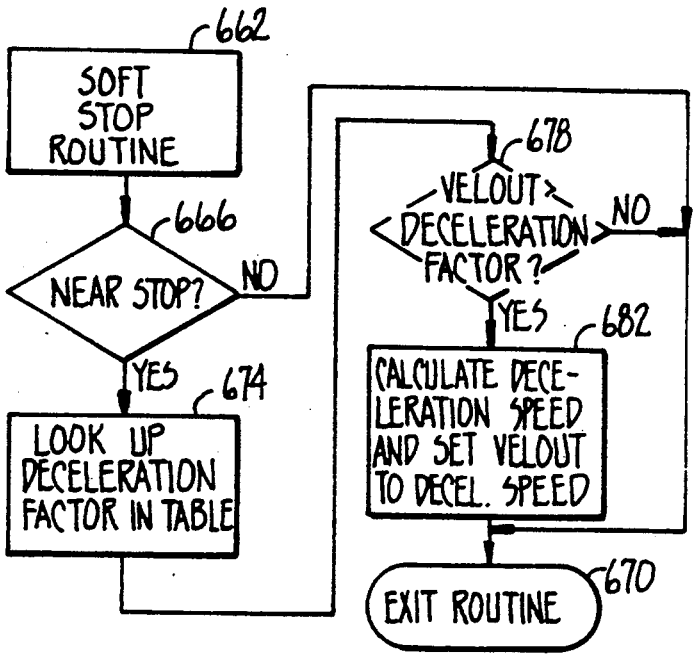

The soft stop routine is entered in a step 662 (FIG. 13). The soft stop routine ensures smooth acceleration from and deceleration to the clockwise and counterclockwise stops. Thus, it is first ascertained in a step 666 whether the lever arm is within a prescribed distance from the clockwise or counterclockwise stop positions. If not, then the routine is exited in a step 670. If so, then the system obtains a deceleration factor from a table, and a deceleration speed is calculated from the deceleration factor. The deceleration factor table is addressed by the lever arm position. It is then ascertained in a step 678 whether the value of VELOUT is greater than the deceleration speed. If so, then VELOUT is set to the deceleration speed in a step 682, and the routine is exited in step 670.

After the soft stop routine is performed, processing continues in step 498 (FIG. 10D).

If the system is not in concentric/concentric mode, it is then ascertained in a step 686 whether the system is in concentric/eccentric or eccentric/concentric mode. In these modes, the patient exerts force on the lever arm in one direction of motion, and the lever arm exerts force on the patient in the other direction of motion. As in concentric/concentric mode, the maximum torque is set in a step 690, and the motor is turned on in a step 694. A CONECC routine is then performed in a step 698.

Figure 15:
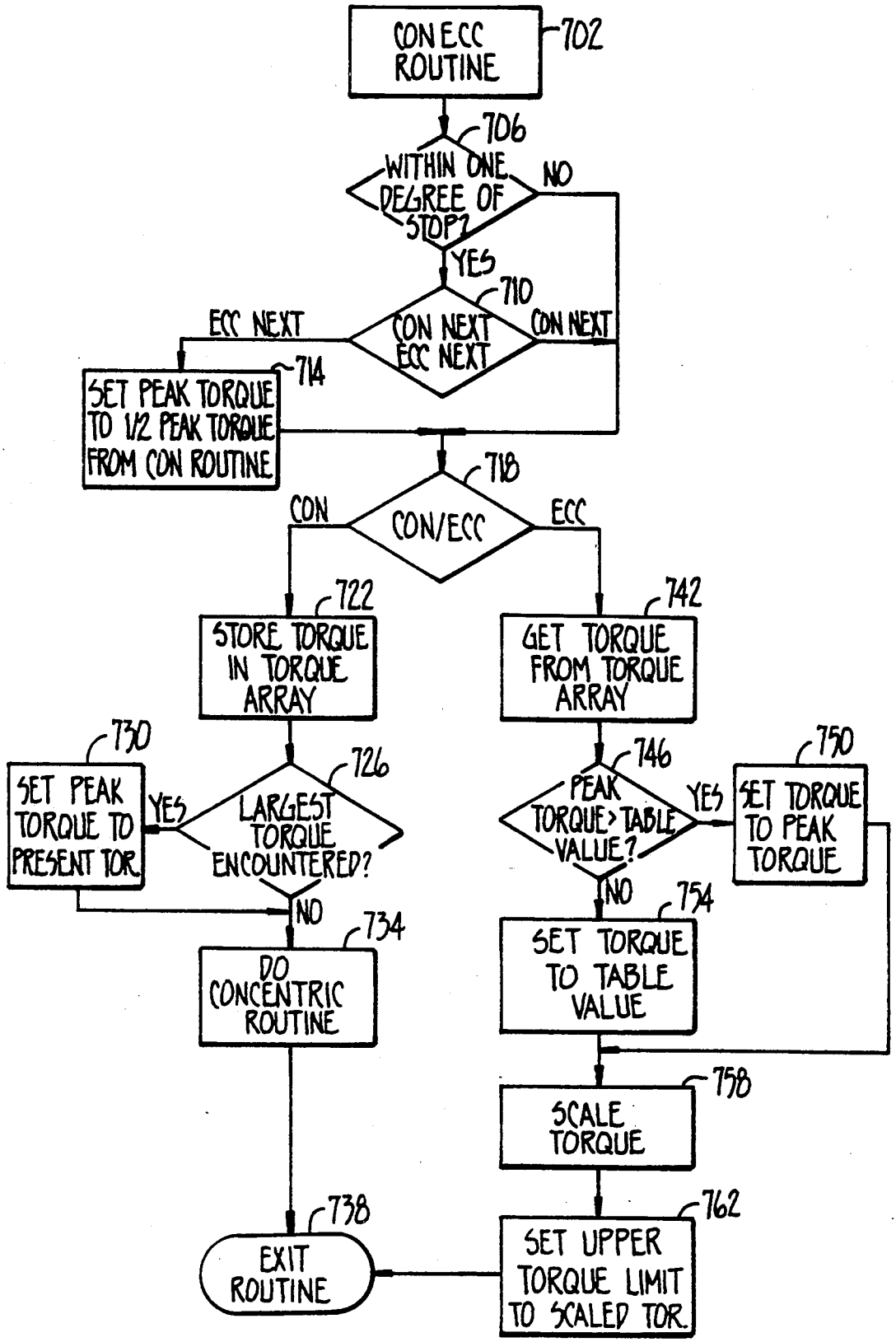

The CONECC routine begins in a step 702 (FIG. 15). The routine initially determines whether the lever arm is within a prescribed distance e.g., 1°, of either the clockwise or counterclockwise stop in a step 706. If so, then the system is to change from concentric mode to eccentric mode or vice versa, and it is ascertained in a step 710 which mode is to be performed next. If eccentric mode is to be performed next, then a peak torque value is set to one half the peak torque value obtained from the previous concentric phase of the routine. This peak torque value is used to set the minimum torque applied to the patient's limb by the lever arm in eccentric mode. The limb is thus exercised based upon the patient's actual performance rather than some theoretical torque set by the operator. Thereafter, it is determined in a step 718 whether the system is now in concentric or eccentric mode. If the system is in concentric mode, then the current torque applied to the lever arm by the patient is stored in a torque array in a step 722, and it is ascertained in a step 726 whether this is the largest torque encountered in this set. If so, then the peak torque (used in eccentric mode as noted above) is set to the present torque in a step 730. If not, then the concentric routine is performed in a step 734. This concentric routine is the same concentric routine shown in FIG. 11. Once the concentric routine is finished, the routine is exited in a step 738.

If it is ascertained in step 718 that the system is in eccentric mode, then the present lever arm position is used in a step 742 to address the torque array that was filled the last time the system was in concentric mode. It is then ascertained in a step 746 whether the peak torque (equal to one half the peak torque encountered the last time the system was in concentric mode) is greater than the addressed torque array value. If so, then the torque to be applied by the lever arm to the patient is set to the peak torque value in a step 750; otherwise the lever arm torque is set to the value stored in the torque array in a step 754. The selected torque value is then scaled in a step 758 to take into account the fact that limbs may be stronger when exercising eccentrically. In this embodiment, the table value is multiplied by 1.5. Finally, the upper torque limit is set to the scaled torque value in a step 762.

The net effect of these torque calculations is that the torque applied to the lever arm by the patient during the last concentric phase is used as a basis for the torque applied to the patient's limb during the eccentric phase, with a minimum torque equal to one half the peak torque encountered during the concentric phase. If the patient is able to resist the lever arm with greater torque than the scaled torque value, then the torque will be limited by the set upper torque limit.

After the CONECC routine is performed, the limit velocity routine is performed in a step 766, the limit torque routine is performed in a step 770, and the soft stop routine is performed in a step 774. These routines are essentially the same as those shown in FIGS. 12, 14, and 13, respectively. The only difference is that, in the limit torque routine (FIG. 14), the execution path changes slightly at step 650 when the system is in eccentric mode. In this case it is then ascertained in a step 775 whether the calculated velocity change will operate to decrease VELOUT. If not, then processing continues in step 654. If so, then it is ascertained in a step 776 whether the calculated velocity change is greater than the current value of VELOUT. If not, then processing continues in step 654. If so, then the velocity change is set to −VELOUT, and processing continues in step 654. The net effect of these calculations is to allow the patient to slow down the lever arm or stop it, but to prevent the patient from reversing direction of rotation.

If the system is not in one of the concentric/eccentric or eccentric/concentric modes, then it is ascertained in a step 778 whether the system is in CPM mode. If so, then the maximum torque is set in a step 782, and the motor is turned on in a step 786. VELOUT is then set to the maximum velocity set by the operator in a step 790 since it is presumed that the patient will not be pushing on the lever arm or resisting the lever arm motion. Nevertheless, the limit velocity routine is performed in a step 794, the limit torque routine is performed in a step 798, and the soft stop routine is performed in a step 802 to ensure that the velocity of and torque applied to the lever arm are in fact the within the proper limits. After the soft stop routine is performed in step 802, processing continues in step 498 (FIG. 10D).

If the system is not in CPM mode, it is then ascertained in a step 806 (FIG. 10D) whether the system is in isometric mode. If so, then the motor is turned off in a step 810, and the motor brake is turned on in a step 814. Of course, VELOUT is set to 0 in this case. Processing then continues in step 498.

If the system is not in isometric mode, then it is determined in a step 818 whether the system is in move limb mode. In this mode, the lever arm moves to a position indicated by the operator. Thus, the motor is turned on in a step 822, and the maximum torque is set in a step 824. Thereafter, the lever arm (and the patient's limb) is moved to the desired position in a step 828. The velocity used in this mode is set by the programmer or may be entered manually. Thereafter, the limit torque routine is performed in a step 832, and the soft stop routine is performed in a step 836. Once the desired position is reached, the state is set to idle in a step 840, and processing continues in step 498.

If the system is not in move limb mode, it is then ascertained in a step 844 whether the system is in parameter entry mode. If so, then the motor is turned off in a step 848, and parameters entered by the operator are accepted by the system in a step 852. Processing then continues in step 498.

If the system is not in parameter entry mode, it is then ascertained in a step 856 whether the system is in lock limb mode. If so, the motor is turned off in a step 860 and the brake is turned on in a step 864. Processing then continues in step 498.

If the system is not in lock limb mode, then a system error exists, and the system is halted in a step 868.

While the above is a complete description of a preferred embodiment of the present invention, various modifications may be employed.

Figure 16:
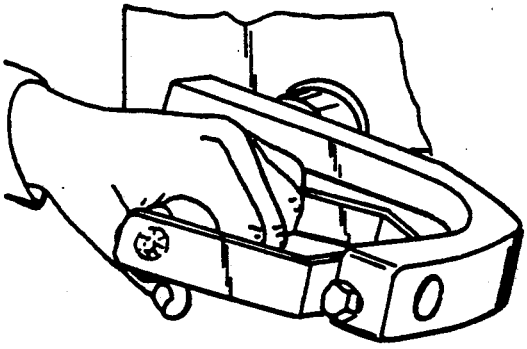
FIGS. 16–32 are diagrams showing alternative embodiments of the present invention.
Figure 17:
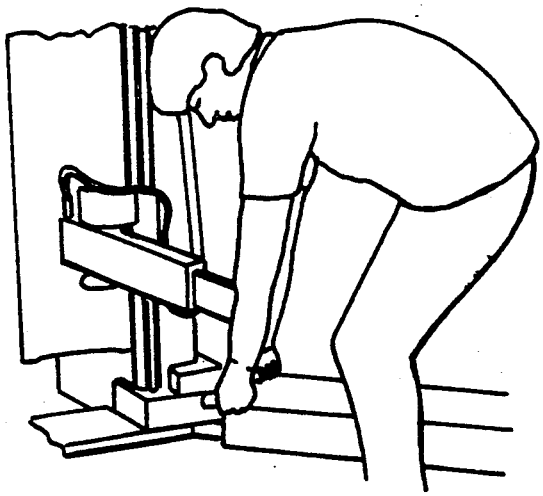
Figure 18:
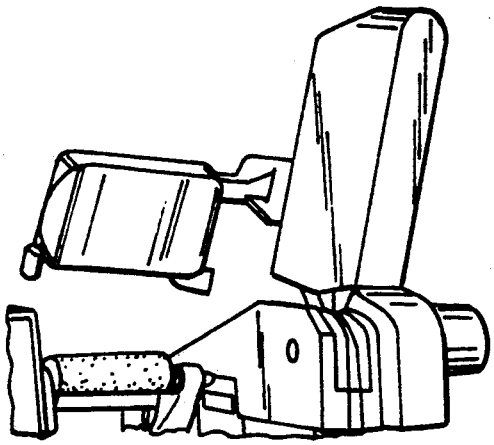
Figure 19:
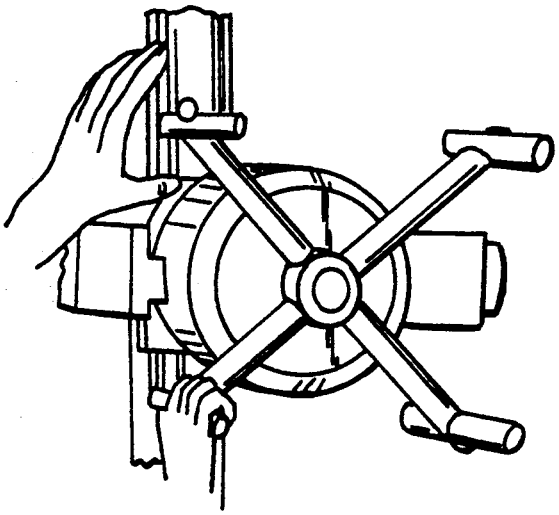
Figure 20:
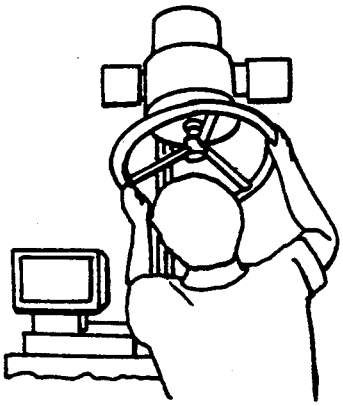
Figure 21:
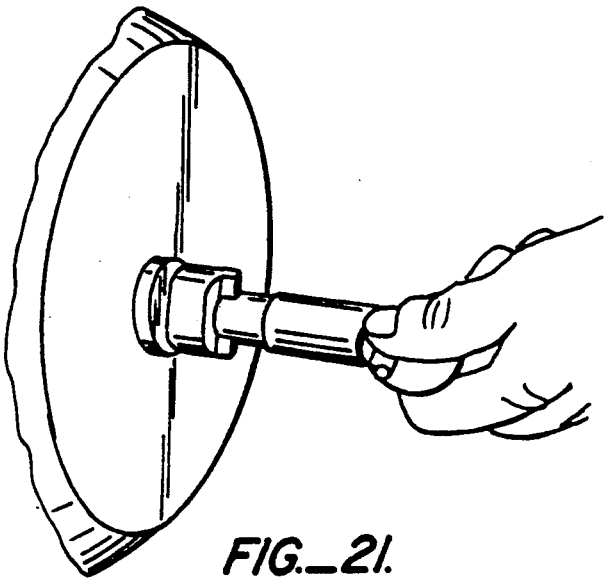
Figure 22:
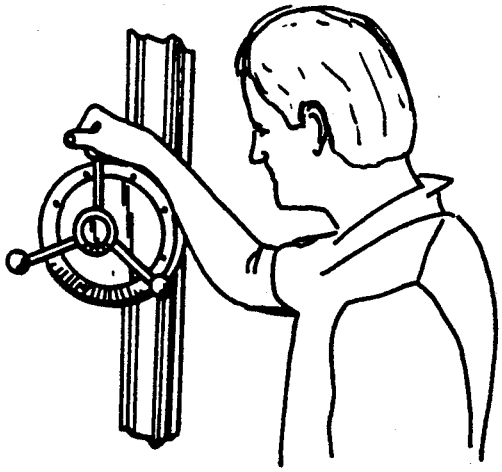
Figure 23:
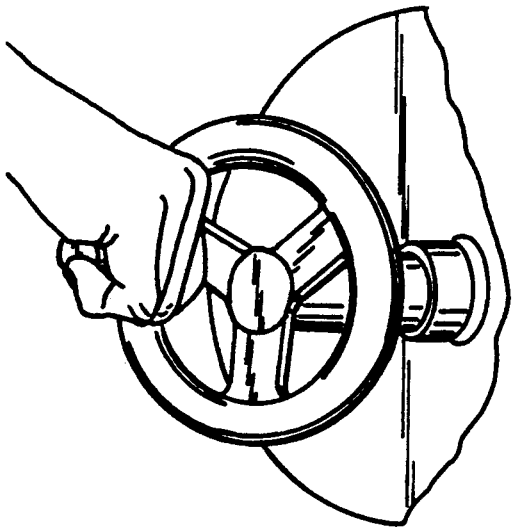
Figure 24:
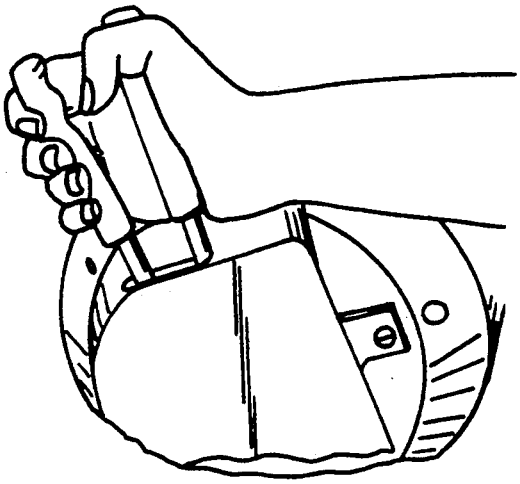
Figure 25:
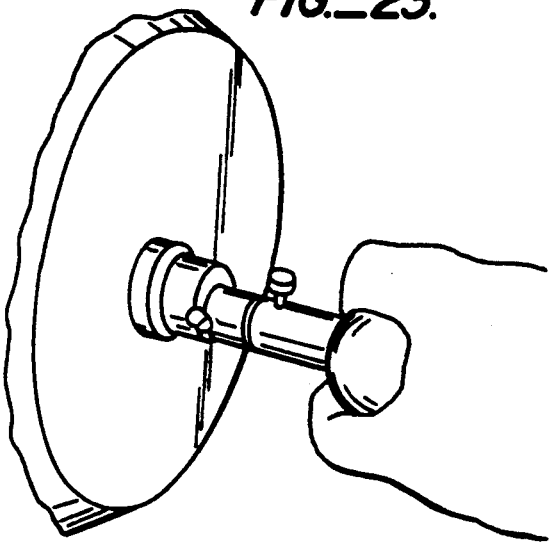
Figure 26:
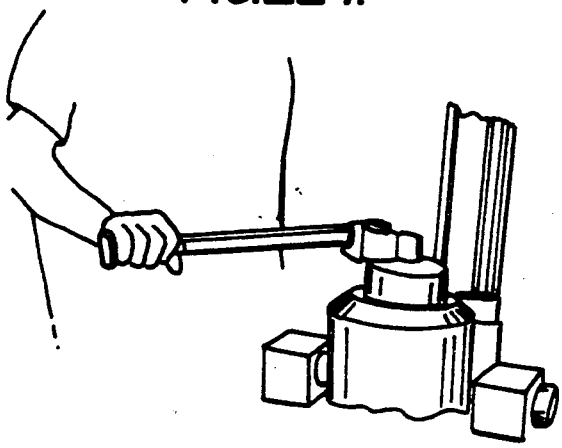
Figure 27:
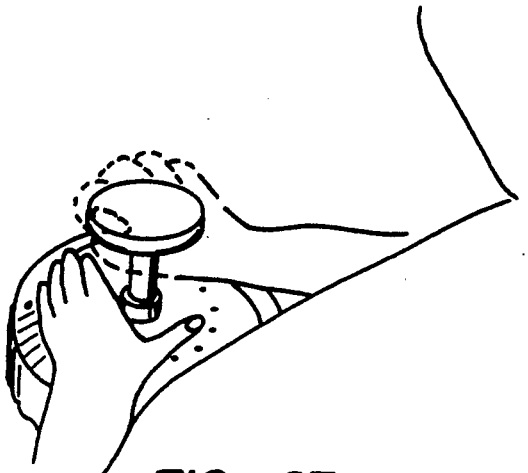
Figure 28:
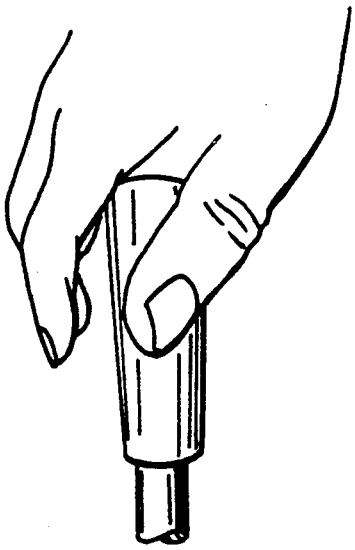
Figure 29:
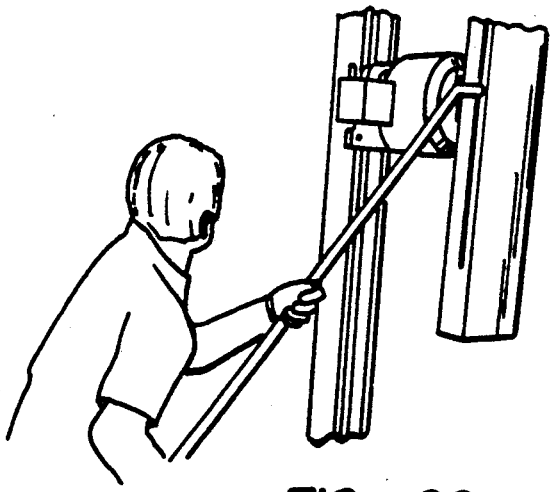
Figure 30:
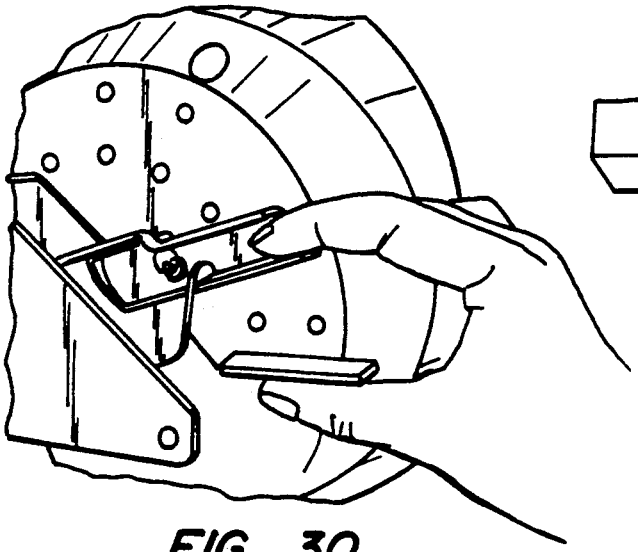
Figure 31:
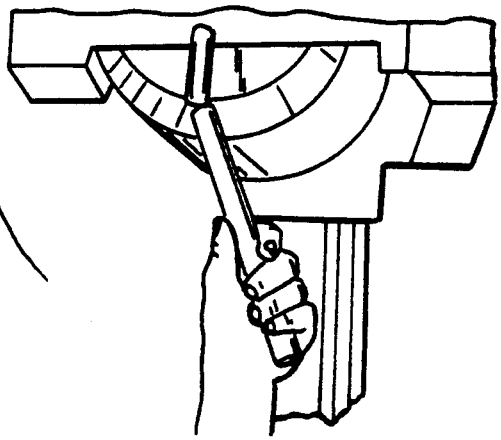
Figure 32:
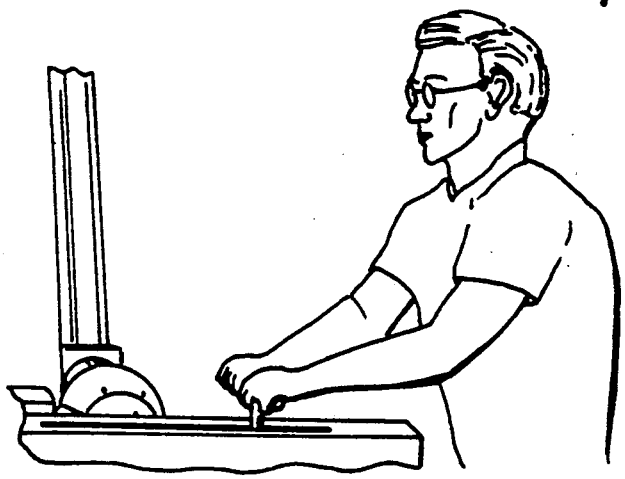

For example, many different patient interface devices may be used with active resistance unit 11 in substitution for lever arm assembly 14. FIG. 16 shows a wrist exercise device; FIG. 17 shows a lift simulation device; FIG. 18 shows a back exercise device; FIG. 19 shows a ladder simulation device; FIG. 20 shows a steering wheel simulation device; FIG. 21 shows a key turning simulation device; FIG. 22 shows a drill press turret simulation device; FIG. 23 shows a crank simulation device; FIG. 24 shows a gripping exercise device; FIG. 25 shows a ball knob simulation device; FIG. 26 shows a wrench simulation device; FIG. 27 shows a disk turning device; FIG. 28 shows a screwdriver simulation device; FIG. 29 shows a window washer simulation device (which could simulate broom sweeping when oriented horizontally); FIG. 30 shows a pinch simulation device; FIG. 31 shows a paintbrush simulation device; and FIG. 32 shows a plane simulation device.

Consequently, the scope of the invention should not be limited except as described in the claims.

What is claimed is:

1. In a muscle exercise and diagnostic system having a shaft for defining a fixed axis of rotation and body interface means for coupling motion of a body to the shaft so that the shaft rotates in response to motion of the body, a motion controller comprising:

velocity selecting means for selecting a desired velocity;

position sensing means for detecting a current rotational position of the shaft and for providing a current position indicating signal in response thereto;

position predicting means, coupled to the velocity selecting means and to the position sensing means, for predicting a first subsequent rotational position of the shaft based on the selected velocity and the current rotational position of the shaft; and motion controlling means, coupled to the shaft and to the position sensing means, for controlling the rotation of the shaft in response to the position indicating signal and the first predicted position.

2. The motion controller according to claim 1 wherein the motion controlling means comprises shaft rotating means, coupled to the shaft and to the position sensing means, for providing rotation of the shaft so that a first actual subsequent rotational position of the shaft substantially matches the first predicted subsequent rotational position.

3. The motion controller according to claim 2 wherein the shaft rotating means comprises:

position comparing means, coupled to the position predicting means and to the position sensing means, for comparing the first predicted rotational position to the first actual subsequent rotational position; and rotation adjusting means, coupled to the position comparing means and to the shaft, for adjusting a rotational velocity of the shaft when the first actual subsequent rotational position does not substantially match the first predicted subsequent rotational position.

4. The motion controller according to claim 3 wherein the position predicting means predicts a second subsequent rotational position of the shaft based on the selected velocity and the first actual subsequent rotational position, and wherein the rotation adjusting means adjusts the rotational velocity of the shaft when the first actual subsequent rotational position does not substantially match the first predicted position so that a second actual subsequent rotational position substantially matches the second predicted subsequent rotational position.

5. The motion controller according to claim 1 further comprising:

torque sensing means, coupled to the shaft, for sensing the amount of torque applied to the shaft and for providing a torque indicating signal in response thereto; and wherein the motion controlling means comprises constant torque means, coupled to the shaft and to the torque sensing means, for providing rotation of the shaft at a constant torque.

6. The motion controller according to claim 5 wherein the constant torque means comprises:

torque selecting means for selecting a torque limit;

torque comparing means, coupled to the torque selecting means and to the torque sensing means, for comparing the selected torque to the sensed torque; and rotation adjusting means, coupled to the torque comparing means and to the shaft, for adjusting a rotational velocity of the shaft when the sensed torque is outside the torque limit.

7. The motion controller according to claim 6 wherein the rotation adjusting means provides for increased rotational velocity of the shaft when the sensed torque is outside the torque limit.

8. The motion controller according to claim 4 further comprising:

torque sensing means, coupled to the shaft, for sensing the amount of torque applied to the shaft and for providing a torque indicating signal in response thereto; and wherein the motion controlling means comprises constant torque means, coupled to the shaft and to the torque sensing means, for providing rotation of the shaft at a constant torque.

9. The motion controller according to claim 8 wherein the constant torque means comprises:

torque selecting means for selecting a torque limit;

torque comparing means, coupled to the torque selecting means and to the torque sensing means, for comparing the selected torque to the sensed torque; and wherein the constant torque means provides rotation of the shaft within the torque limit.

10. The motion controller according to claim 9 wherein the constant torque means is coupled to the rotation adjusting means and provides for increased rotational velocity of the shaft when the sensed torque is outside the torque limit.

11. The motion controller according to claim 10 wherein the motion controlling means further comprises:

a motor coupled to the shaft; and motor drive means, coupled to the motor and to the rotation adjusting means, for selectively rotating the shaft in response to the rotation adjusting means.

12. The motion controller according to claim 11 wherein the motor drive means supplies current to the motor so that the motor rotates the shaft in response to the amount of current supplied.

13. The motion controller according to claim 12 wherein the position comparing means calculates a difference value representing a difference between the first predicted subsequent rotational position and the first actual subsequent rotational position, and wherein the rotation adjusting means provides a current command to the motor drive means based on the difference value, so that the motor drive means supplies current to the motor in response to the difference value.

14. The motion controller according to claim 1 wherein the motion controlling means comprises:

range selecting means for selecting a range of motion for the body interface means; and range limiting means, coupled to the range selecting means and to the shaft, for controlling rotation of the shaft so that movement of the body interface means is limited to the selected range of motion.

15. The motion controller according to claim 14 wherein the range limiting means comprises:

clockwise stop setting means, coupled to the range selecting means, for setting a clockwise stop position;

counterclockwise stop setting means, coupled to the range selecting means, for setting a counterclockwise stop position; and wherein the range limiting means limits rotation of the shaft to positions between the clockwise and counterclockwise stop positions.

16. The motion controller according to claim 15 wherein the motion controlling means further comprises soft stop means for limiting a rotational velocity of the shaft when the shaft is positioned in close proximity to the clockwise and counterclockwise stop positions.

17. The motion controller according to claim 16 wherein the soft stop means gradually decreases the rotational velocity of the shaft as the shaft moves closer to the clockwise and counterclockwise stop positions.

* * * * *